United States Patent [19]

Morishita et al.

[11] Patent Number: 4,846,639

[45] Date of Patent: Jul. 11, 1989

[54] SCROLL COMPRESSOR WITH MEMBERS PRESSING ROTATING SCROLLS RADIALLY AND AXIALLY

[75] Inventors: Etsuo Morishita; Masayuki Kakuda, both of Amagasaki; Masahiro Sugihara, Wakayama; Tsutomu Inaba, Wakayama, all of Japan

[73] Assignee: Mitsubishi Denki Kabushiki Kaisha, Tokyo, Japan

[21] Appl. No.: 147,532

[22] Filed: Jan. 25, 1988

Related U.S. Application Data

[63] Continuation of Ser. No. 22,083, Mar. 5, 1987, abandoned.

[30] Foreign Application Priority Data

Mar. 7, 1986 [JP] Japan ..... 61-50818

[51] Int. Cl.[4] ..... F04C 18/04

[52] U.S. Cl. ..... 418/55; 418/57; 418/88

[58] Field of Search ..... 418/55, 57, 188, 88

[56] References Cited

U.S. PATENT DOCUMENTS 3,884,599 5/1975 Young et al. ..... 418/57

4,575,318 3/1986 Blain ..... 418/188

*Primary Examiner*—John J. Vrablik

*Attorney, Agent, or Firm*—Oblong, Spivak, McClelland, Maier & Neustadt

[57] ABSTRACT

A scroll compressor comprises a driving scroll, a driven scroll combined with the driving scroll to be driven by the same through the mutual contact of the wrap plates of the both scrolls, a movable bearing support held in a sealing container so as to be movable in the axial and radial directions of the container. The movable bearing support supports the driven scroll so that the driven scroll is pushed in the radial direction of the container, whereby gaps formed between the wrap plates of the driving and driven scrolls can be avoided.

5 Claims, 4 Drawing Sheets

SCROLL COMPRESSOR WITH MEMBERS PRESSING ROTATING SCROLLS RADIALLY AND AXIALLY

This is a continuation of application Ser. No. 022,083, filed Mar. 5, 1987, now abandoned.

BACKGROUND OF THE INVENTION

1. Field of the Invention

The present invention relates to a total system rotation type scroll compressor in which a driven scroll is directly rotated by a driving scroll.

More particularly, it relates to a sealing means for sealing gaps produced in the radial direction of the contacting areas of the wrap plates of the driving and driven scrolls and an abnormal pressure releasing means for releasing an abnormal pressure produced in a compression chamber for a total system rotation type scroll compressor.

2. Discussion of Background

The principle of the scroll compressor has been known. The scroll compressor is a kind of a positive displacement type compressor in which a pair of scrolls are combined with each other and rotated to effect compression of a fluid.

In the ordinary scroll compressor, one of the scrolls is made stationary and the other is subject to an orbital movement with respect to the stationary scroll to effect the compression.

The principle of the total system rotation type scroll compressor in which both scrolls are respectively rotated around their own axial center, is also well known.

FIG. 2 shows the principle of the total system rotation type scroll compressor. A driving scroll 1 is caused to rotate around its own axial center $O_1$ by a driving source such as a motor, an engine, a turbine and so on. A driven scroll 2 is also caused to rotate around its axial center $O_2$ in synchronism with the rotation of the driving scroll 1. A compression chamber 3, which is formed by combining the driving and driven scrolls 1, 2, moves toward the rotation centers as the both scrolls rotate while the volume of the chamber 3 is gradually reduced. The pressure of a gas confined in the compression chamber 3 increases and a highly pressurized gas is discharged through a dischage port *2c*.

FIG. *2a* shows a state of the combined driving and driven scrolls 1, 2 at its moving phase of 0°, in which the gas is sucked in the compression chamber 3. As the scrolls rotate, they assume the moving phases of 90°, 180°, 270° and 360° (0°) succesively as shown in FIGS. *2b–2d*, whereby the compression chamber 3 gradually shifts toward their revolution centers with the result of reduction in the volume of the gas. The two scrolls 1, 2 provide sealing portions by mutual contact of the side walls of the wrap plates 1*a*, 2*a* of the scrolls 1, 2. As shown in FIG. 2, the sealing portions s are in alignment with each other in the radial direction of the driving and driven scrolls 1, 2; namely, they always occupy a constant positional relation in view of a static condition of the scrolls.

The conventional total system rotation type scroll compressor constructed as above-mentioned has problems as follows.

There is provided no sealing means for sealing gaps which may be produced in the radial direction of the contacting areas formed by the mutual cotact of the wrap plates of the driving and driven scrolls. Accordingly, the gas in the compression chamber leaks from the gaps to result in reduction in performance of the compressor.

Further, when the conventional scroll compressor is applied, for instance, to a refrigerant compressor, the scrolls are sometimes broken because it is not provided with an abnormal pressure releasing means when a phenomenon of liquid compression has occurred.

SUMMARY OF THE INVENTION

It is an object of the present invention to provide a scroll compressor which prevents leakage of a gas in a compression chamber through gaps produced in the contacting areas of the wrap plates of the driving and driven scrolls, and automatically releases an abnormal pressure of the gas in the compression chamber to avoid the breakage of the scrolls.

The foregoing and the other objects of the present invention have been attained by providing a sealing container, a driving scroll rotatably held in the sealing container, a driven scroll with a wrap plate which is combined with the wrap plate of the driving scroll so as to be driven by the driving scroll through the mutual contact of the wrap plates, a movable bearing support which is held in the sealing container so as to be movable in the radial and axial directions of the container along the line passing through the axial centers of the driving and driven scrolls and which supports the upper surface and the shaft portion of the driven scroll through bearings; a first pressing member for pushing the movable bearing support so as to broaden the distance between the axial centers of the both scrolls; and a second pressing member for pushing the movable bearing support from the top, wherein an abnormal inner pressure produced in a compression chamber formed by the both scrolls pushes the driven scroll upwardly to thereby release the abnormal inner pressure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
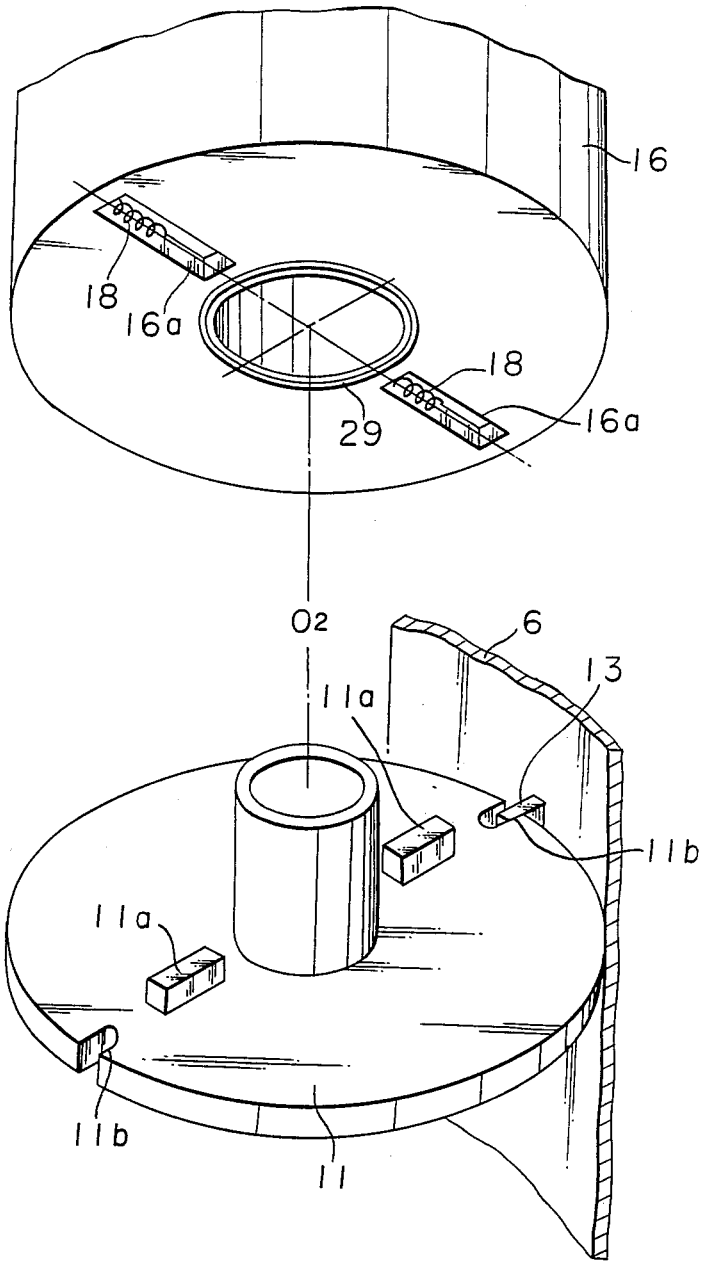
FIG. 3 is an exploded perspective view of a movable bearing support and a pressing body which constitute an important part of an embodiment of the scroll compressor according to the present invention.

A preferred embodiment of the present invention will be described with reference to FIGS. 1 and 3.

Figure 1:
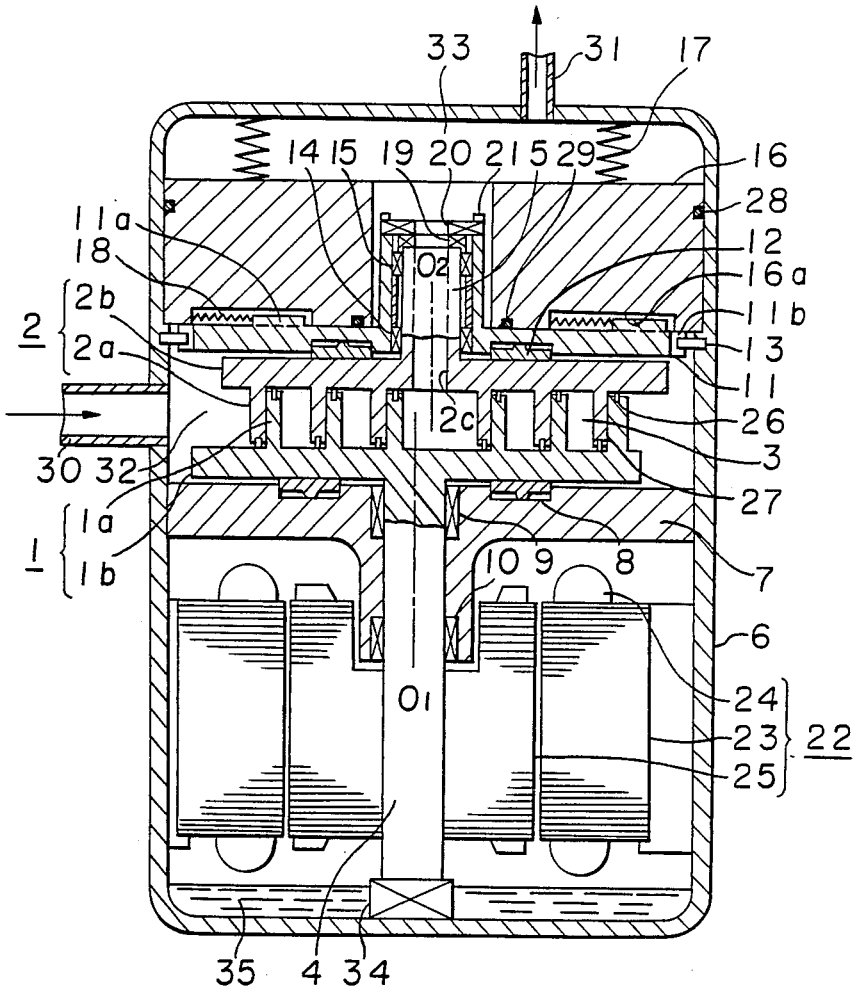
FIG. 1 is a longitudinal cross-sectional view of an embodiment of the scroll compressor according to the present invention.

FIG. 1 shows a total system rotation type scroll compressor without using an Oldham coupling. In FIG. 1, a reference numeral 6 designates a generally cylindrical container which is placed with the axial center line kept upright. A driving scroll 1 is placed inside the container 6 and it has a circular plate 1*b*, a wrap plate 1*a* formed on the upper surface of the circular plate 1*b* and a driving shaft 4 firmly attached to or integrally formed with the circular plate 1*b* so as to extend downwardly.

A driven scroll 2 is placed above the driving scroll 1. The driven scroll 2 has a wrap plate 2*a* formed on the lower surface of a circular plate 2*b*, which is combined with the wrap plate 1*a* of the driving scroll 1 so as to be driven by the driving scroll 1 through the mutual contact of the wrap plates 1*a*, 2*a*. The driven scroll 2 is provided with a shaft 5 firmly attached to or integrally formed with the upper surface of the circular plate 2*b* so as to extend upwardly. A discharge port 2*c* is formed in the shaft 5 along the axial center line.

A lower bearing support 7 is firmly attached to the inner wall of the container 6. The circular plate portion of the lower bearing support 7 supports the lower surface of the circular plate 1*b* of the driving scroll 1 through a thrust bearing 8. The hollowed boss portion of the lower bearing support also supports the driving shaft 4 in the radial direction through a pair of bearings 9, 10.

A movable bearing support 11 is placed above the driven scroll 2 to support the upper surface of it through a thrust bearing 12. The movable bearing support 11 is adapted to be movable in the axial direction of the container 6, but the movement of rotation is prohibited by the engagement of a pair of recesses 11*b* formed in the peripheral part of the support 11 with a pair of whirl-stop pins 13 fixed to the container 6. The movable bearing support 11 is also adapted to be movable in the radial direction along a line passing through the axial centers $O_1$, $O_2$ of the both driving and driven scrolls 1, 2. A pair of projections 11*a* are provided, diametrically aligned, on the upper surface of the movable bearing support 11. The shaft 5 of the driven scroll 2 is rotatably supported by the movable bearing support 11 through bearings 14, 15. The thrust bearings 8, 12 may respectively be tilting-pad-thrust bearings.

A pressing body 16 is placed on the movable bearing support 11 so as to be movable in the axial direction of the container, but the lowest position of the movement is determined with respect to the container 6. A plurality of compression springs 17 are interposed between the upper surface of the pressing body 16 and the inner wall of the container 6 and comprise first biasing means so that the pressing body is normaly urged downwardly and bears a thrusting force given by the driven scroll 2. A pair of guide grooves 16*a* are formed, diametrically aligned, in the lower surface of the pressing body 16 so as to be engagable with the projections 11*a* to form radial stops. Each compression spring 18 (second biasing means) is fitted in each of the guide grooves. The springs push the driven scroll 2 in the direction to expand the distance between the axial centers $O_1$, $O_2$ through the movable bearing support 11.

A reference numeral 19 designates a rotary mechanical seal attached to the top end of the shaft 5 of the driven scroll 2 and a numeral 20 designates a fixed mechanical seal attached to the upper end of the movable bearing support 11 by means of fitting screws 21. The fixed mechanical seal 20 is in contact with the rotary mechanical seal 19 to provide a shaft-sealing for the shaft 5.

An electric motor 22 as a driving source comprises a stator iron core 23 with a stator coil 24 which is fixed to the inner wall of the container 6 and a rotor 25 fixed to the driving shaft 4.

Tip seals 26, 27 are respectively fitted in spiral grooves formed in the end surface of the wrap plates 1*a*, 2*a*. O-rings 28, 29 are respectively fitted in annular grooves formed in the pressing body 16 for providing sealings. An intake tube 30 is connected to the sealing container 6 to introduce a gas into the scrolls 1, 2. A discharge tube 31 is connected to the top of the container 6 to forcibly feed the compressed gas to the outside of the container. A suction chamber 32 is defined by the inner wall of the container 3, the lower bearing support 7 and the lower surface of the pressing body 16. A discharge chamber 33 is defined by the inner wall of the container 6 and the upper surface of the pressing body 16. An oil pump 34 is connected to the lower part of the driving shaft 4. When the driving shaft is rotated, the pump supplies a lubricating oil 35 stored in the bottom of the container 6 through a oil feeding pipe (not shown), whereby the oil 35 lubricates mechanical seals 19, 20 and the bearings and then, it is returned to the bottom of the container 6.

The operation of the scroll compressor having the construction as above-mentioned will be described.

Figure 2:
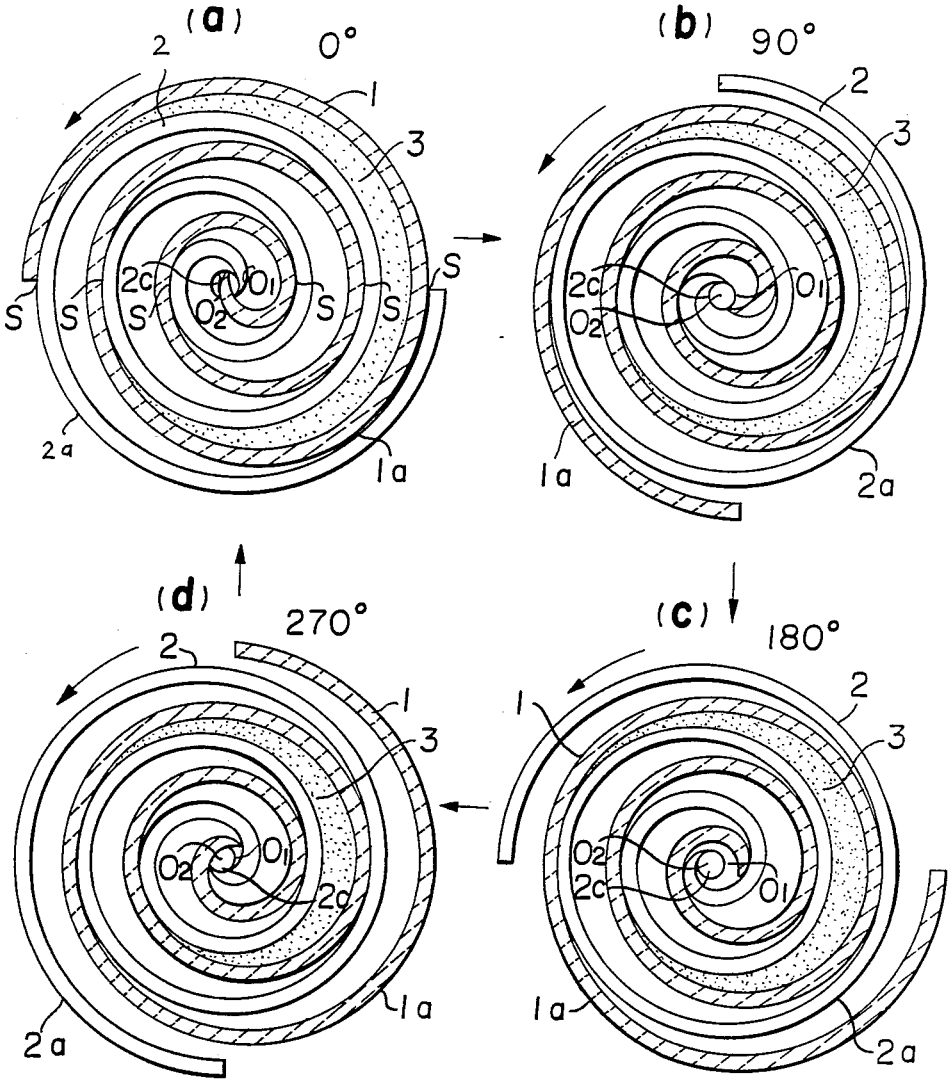
FIGS. 2(*a*) to 2(*d*) are diagrams showing the principle of the operation of the typical total system rotation type scroll compressor.

On actuating the motor 22, the driving scroll 1 is rotated around the own axial center $O_1$. Then, the driven scroll 2 is rotated around the own axial center $O_2$ by the driving scroll 1 through the mutual contact of the wrap plate 1*a* of the driving scroll 1 and the wrap plate 2*a* of the driven scroll 2. The rotation of the both scrolls performs the function of suction, compression and discharge of the gas as shown in FIG. 2.

The associated revolution of the scrolls 1, 2 sucks the gas into the suction chamber 32 through the intake tube 30 and then, the gas is introduced in the compression chamber 3. As the scrolls 1, 2 rotate, the compression chamber moves toward their revolution centers while the volume of the compression chamber 3 is reduced to compress the gas, and finaly the compressed gas is forcibly supplied to the outside through the discharge port 2*c* and the discharge tube 31.

The movable bearing support 11 is pushed by the compression springs 18 in the direction to expand the distance between the axial centers $O_1$, $O_2$, thereby prohibiting formation of gaps at the contacting areas in the radial direction of the wrap plates 1*a*. Accordingly, the compression chamber 3 is maintained at a highly airtight condition and leakage of the compressed gas is avoided. The tip seals 26, 27 seal the gaps produced between the top ends of the wrap plates 1*a*, 2*a* and the surface of the circular plates 1*b*, 2*b*.

If foreign substances enter between the side surfaces of the wrap plates 1*a*, 2*a*, the distance between the axial centers $O_1$, $O_2$ is reduced against the spring action of the compression springs 18 and the foreign substances are discharged.

In the case that the compressor of the present invention is used as a refrigerant compressor, the refrigerant liquid may enter in the compression chamber 3 to cause an abnormal inner pressure of the compression chamber. In this case, a thrusting force by the abnormal inner pressure which directs the driven scroll 2 upward is transmitted to the pressing body 16 through the thrust bearing 12 and the movable bearing support 11. Then, the pressing body 16 is slightly moved upward against the spring action of the compression springs 17. Thus, the driven scroll 2 is slightly pushed up whereby slight gaps are produced between the end surfaces of the wrap plates 1*a*, 2*a* and the surfaces of the circular plates 1*b*, 2*b* facing the end surfaces of the wrap plates with the result that the abnormal inner pressure is released from the compression chamber 3. By releasing the abnormal inner pressure, the pressing body 16 is moved downwardly by the spring action of the compression springs 17, and then, the movable bearing support 11 and the driven scroll 2 return to the normal position so that the normal compressing operations are performed.

A part of the gas to be sucked into the scrolls 1, 2 or a part of the lubricating oil 35 falling on the bottom of the container may be utilized to cool the stator 23 and the rotor 25 of the motor 22.

An oil pressure given by the oil pump 34 or the pressure of the compressed gas to be discharged may be utilized to push the movable bearing support 11 in the radial direction, instead of the compression springs 18.

The oil pressure and the compressed gas pressure may also be utilized to push down the pressing body 16 in the axial direction of the container, instead of the compression springs 17.

Figure 4:
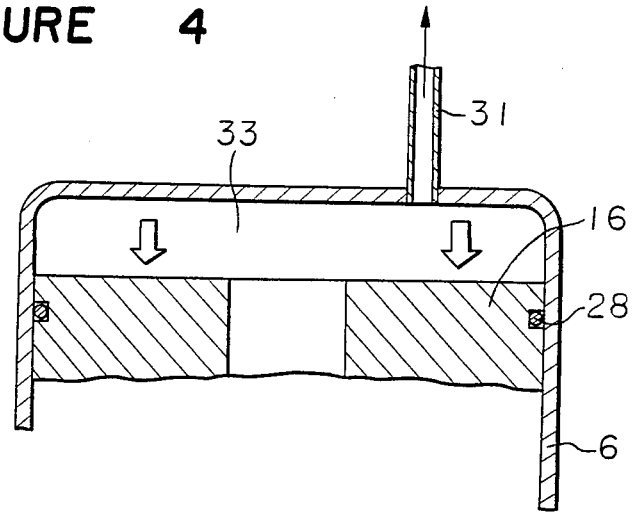
FIG. 4 is a cross-sectional view partly broken of an embodiment of a pressing member for pressing the movable bearing support.
Figure 5:
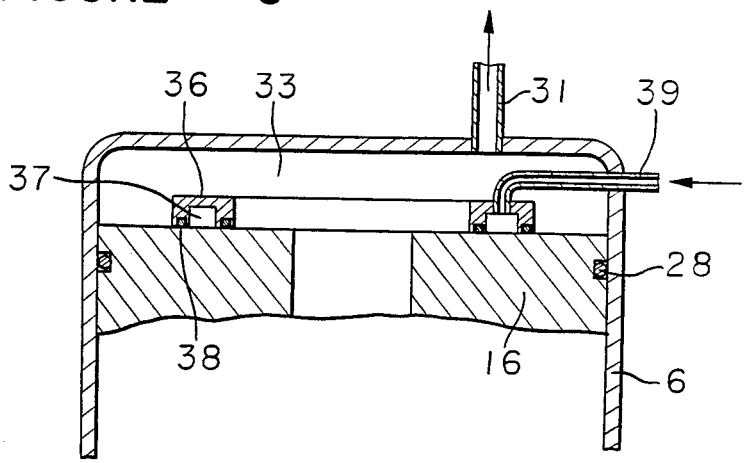
FIG. 5 is a cross-sectional view partly broken of another embodiment of the pressing member used for the scroll compressor of the present invention.

FIG. 4 shows an embodiment of pressing down the pressing body 16 by utilizing the compressed gas pressure in the discharge chamber 33. FIG. 5 shows another embodiment for pressing down the pressing body 16 in which an annular oil pressure chamber 36 is provided on the upper surface of the pressing body 16 and an oil feeding tube 39 passes through the container 6 and one end of the tube is connected to the annular chamber 38. When oil 37 is forcibly fed into the chamber 36, the pressing body is moved downward. A reference numeral 38 designates an O-ring.

In the above-mentioned embodiment, the tilting-pad-thrust bearing is used for the thrust bearings 18, 12. However, a plane bearing, a static pressure bearing, a thrust-roller bearing or a spiral groove bearing may be used as the thrust bearing.

Thus, in accordance with the scroll compressor of the present invention, production of the gaps at the contacting areas between the wrap plates 1, 2 is prohibited, whereby efficiency of compression is increased. Further, when an abnormal inner pressure is produced in the compression chamber, the driven scroll is pushed up against a given pressing means to release the abnormal inner pressure to thereby avoid the breakage of the scrolls. The scroll compressor of the present invention is, therefore, highly reliable.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll compressor comprising:

a sealing container;

a driving scroll having a wrap plate and rotatably held in said sealing container;

a driven scroll having a wrap plate combined with the wrap plate of said driving scroll so as to define at least one compression chamber therebetween and so as to be driven by said driving scroll through the mutual contact of the wrap plates;

a pressing body axially slidably fitted in said sealing container;

a bearing support positioned in said sealing container between said driven scroll and said pressing body, said bearing support comprising means for supporting said driven scroll and being radially and axially movable relative to said sealing container;

means for permitting said driven scroll to resiliently axially separate from said driving scroll in response to an abnormal pressure in said at least one compression chamber so as to release said abnormal pressure, said means for permitting said driven scroll to resiliently axially separate comprising first biasing means for biasing said pressing body into contact with said bearing support;

means for restraining rotational movement of said bearing support while permitting said axial separation of said driven scroll from said driving scroll;

means for resiliently separating axial centers of said driving and driven scrolls, comprising second biasing means operatively connected between said pressing body and said bearing support for radially biasing said bearing support relative to said pressing body; and radial stop means formed between said pressing body and said bearing support to limit the radial separation of said radial centers of said driving and driven scrolls;

whereby said second biasing means and said radial stop means are not affected by axial movement of said bearing support.

2. The scroll compressor of claim 1, wherein said pressing body has at least one groove and said bearing support has a projection fitted into each of said grooves to form said radial stop means and wherein said second biasing means comprises a spring in each said groove and pressing on the projection therein.

3. The scroll compressor according to claim 1, wherein each of said first and second biasing means comprises a compression spring.

4. The scroll compressor according to claim 1, wherein said first biasing means is operated by the pressure of a compressed gas to be discharged.

5. The scroll compressor according to claim 1, wherein said first biasing means is operated by an oil pressure produced by an oil pump which is actuated by the driving shaft of said driving scroll.

* * * * *